United States Patent [19]

Markus

[11] Patent Number: 4,880,273

[45] Date of Patent: Nov. 14, 1989

[54] RECLINING CHAIR HAVING SUSPENDED SEATING

[76] Inventor: Isidoro N. Markus, 65-36 99th St. (1E), Rego Park, N.Y. 11374

[21] Appl. No.: 300,576

[22] Filed: Jan. 23, 1989

Related U.S. Application Data

[63] Continuation-in-part of Ser. No. 217,823, Jul. 12, 1986, Pat. No. 4,819,986.

[51] Int. Cl.[4] ..... A47C 1/02

[52] U.S. Cl. ..... 297/325; 297/68; 297/88; 297/276; 297/282

[58] Field of Search ..... 297/68, 88, 325, 276, 297/273, 277, 280, 281, 282

[56] References Cited

U.S. PATENT DOCUMENTS

| | | | |
|---|---|---|---|
| 2,807,310 | 9/1957 | Sellner | 297/88 |
| 3,116,091 | 12/1963 | Bethoon et al. | 297/325 |
| 3,806,193 | 4/1974 | Faiks | 297/325 |
| 4,092,041 | 5/1978 | Landry et al. | 297/68 |
| 4,383,714 | 5/1983 | Ishida | 297/325 |
| 4,700,920 | 10/1987 | Horn | 297/281 X |

*Primary Examiner*—James T. McCall

*Attorney, Agent, or Firm*—Kane, Dalsimer, Sullivan, Kurucz, Levy, Eisele and Richard

[57] ABSTRACT

A reclining chair is provided comprising a tubular frame and a seating secured to said frame by a flexible member. The flexible member slides over a raceway positioned lengthwise inside said tubular frame, whereby the seating is suspended from the frame. Means are provided to guide the motions of the flexible member and those of the seating.

7 Claims, 4 Drawing Sheets

RECLINING CHAIR HAVING SUSPENDED SEATING

CROSS-REFERENCE TO OTHER APPLICATIONS

The present patent application is a continuation-in-part of co-pending U.S. patent application Ser. No. 07/217,823 filed Jul. 12, 1988, now U.S. Pat. No. 4,819,986, entitled "Reclining Chair With Suspended Seating".

BACKGROUND OF THE INVENTION

The present application relatestto reclining chairs, and in particular to such chairs wherein the seating is suspended from the frame by means of flexible members such as cables, plastic or metallic strips, chains, or the like.

The common chair, normally comprises a fixed frame supporting a seating board and a back board. To increase comfort both boards may be upholstered, and the frames may be designed with some structural flexibility. It has been shown, however, that the greatest user's comfort comes from a chair's ability to assume different seating positions which the conventional side chair can not provide, since it is basically rigid. When comfort is paramount and cost, weight and looks are secondary, some side chairs have been built like office task chairs comprising a spider base, which is connected at its upper end to a reclining mechanism having a pivotal axis extending from side to side of the seating.

In the above mentioned co-pending patent application advanced there is disclosed a reclinable mechanism which is totally inside the tubular chair frame. The advantages of this chair over conventional reclining side chairs are lower weights and costs. In addition the chair presents a very clean look since the reclinable mechanism is hidden. One disadvantage of this chair, however, is that the seat is suspended by flexible metallic straps which travel over wheels. This results in assembly problems in that the wheels must be precisely positioned within the frame members as well as reliability problems. Moreover, the cross section of the frame members of this chair must be sufficiently large to accommodate the wheels and the wheels must be sufficiently large to support the weight of the user.

In view of the above, it is the principal object of the present invention to provide an improved reclining chair which maintains the advantages of the chair described in the co-pending application doing away with the shortcomings mentioned above.

It is a further object to provide such a chair which introduces new levels of comfort and aesthetics to the user, is safe to use and economical to manufacture.

SUMMARY OF THE INVENTION

The above and other beneficial objects and advantages are attained in accordance with the present invention by providing an improved reclining chair which includes a chair frame and rigid seating which is suspended from the frame by means of flexible members or elements such as cables, plastic or metallic strips, chains, or combinations of the above. The seating is supported by the flexible members so as to enable it to rotate with respect to the chair frame thereby enabling the user to vary his position from upright sitting to reclining. The seating is supported from above so that in all seating positions the chair is basically stable. The stability of the chair is enhanced by the widely spaced suspension points of the seating which results in a generous latitude for the center of gravity of the load. In addition, the friction of the flexible members over the fixed raceway creates a brake force proportional to the load which inhibits further motion once a position is assumed. Therefore, any seating position is easily assumed by a user and retained.

The chair of the present invention permits a simplification over the reclining mechanism disclosed in my co-pending patent application by substituting a plurality of rolls for a single raceway.

DETAILED DESCRIPTION OF THE PREFERRED EMBODIMENT

Figure 1:
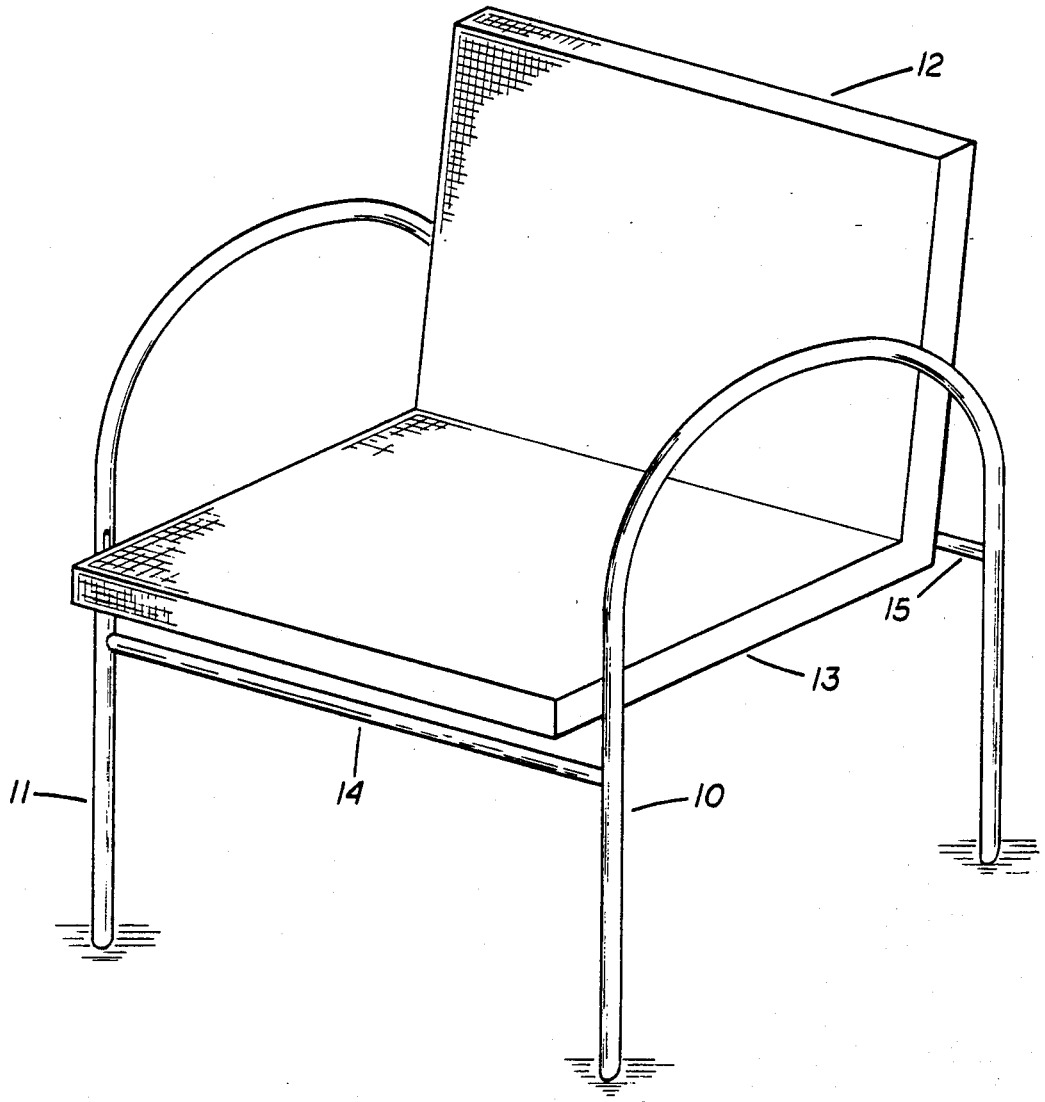
FIG. 1 a perspective view of a reclining chair in accordance with the present invention.

Referring now in detail to FIG. 1, the chair of the present invention comprises a supporting metal frame formed of two inverted u-shaped tubular side frame members 10, 11 each shaped to provide an arm rest connected to vertical leg members. The frame supports the seating 12,13. A front cross-rail 14 extends between the frame members 10, 11 at the front of the chair and a rear cross-rail 15 extends across the rear of the chair to rigidize the chair frame.

The seating comprises an upholstered seat board 13 and an upholstered back board 12 which are rigidly connected together to each other at an obtuse angle.

It will be understood that the hardware is symmetrically disposed on both sides of the chair. Hence, the hardware on one side only will be described.

Figure 2:
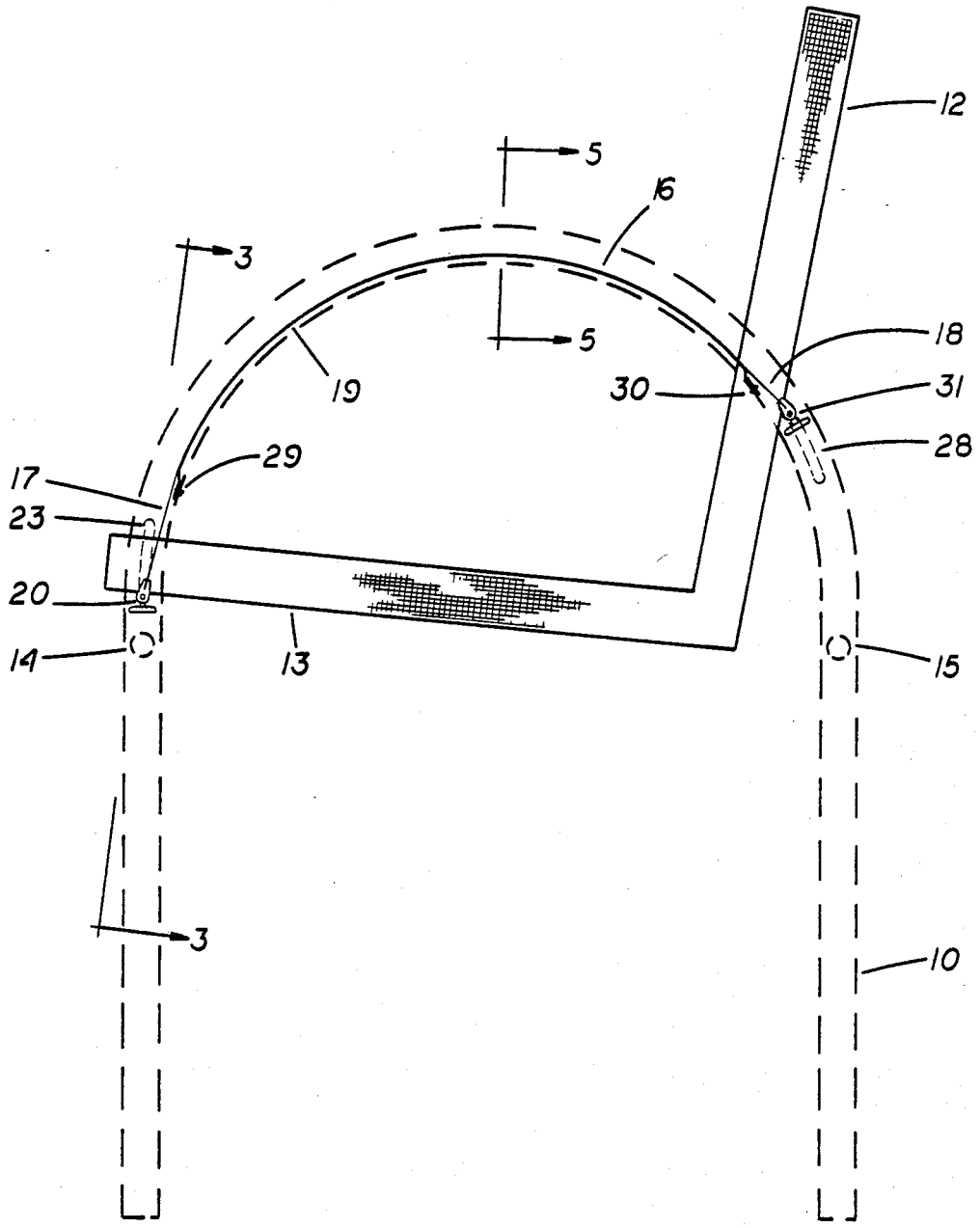
FIG. 2 a somewhat schematic side elevational view of the seating and suspension portions of the chair of FIG. 1 with the seating in an upright position.

Referring now to FIG. 2, it can be seen that the seating 12,13 is suspended from the tubular frame by one flexible member in the form of a metallic flat strap 16, terminating at ends 17 and 18. Ends 17 and 18 are respectively attached to the seat board 13 and the back board 12. Motion of the seating, as for example to shift the seating from the position of FIG. 2 to that of FIG. 6 or vice versa, is accomplished by the flexible member 16 sliding over a smooth steel raceway surface represented by the fixed metallic strip 19. Rivets 29 and 30 securely attach the ends of raceway 19 to the inside of frame 10.

Figure 3:
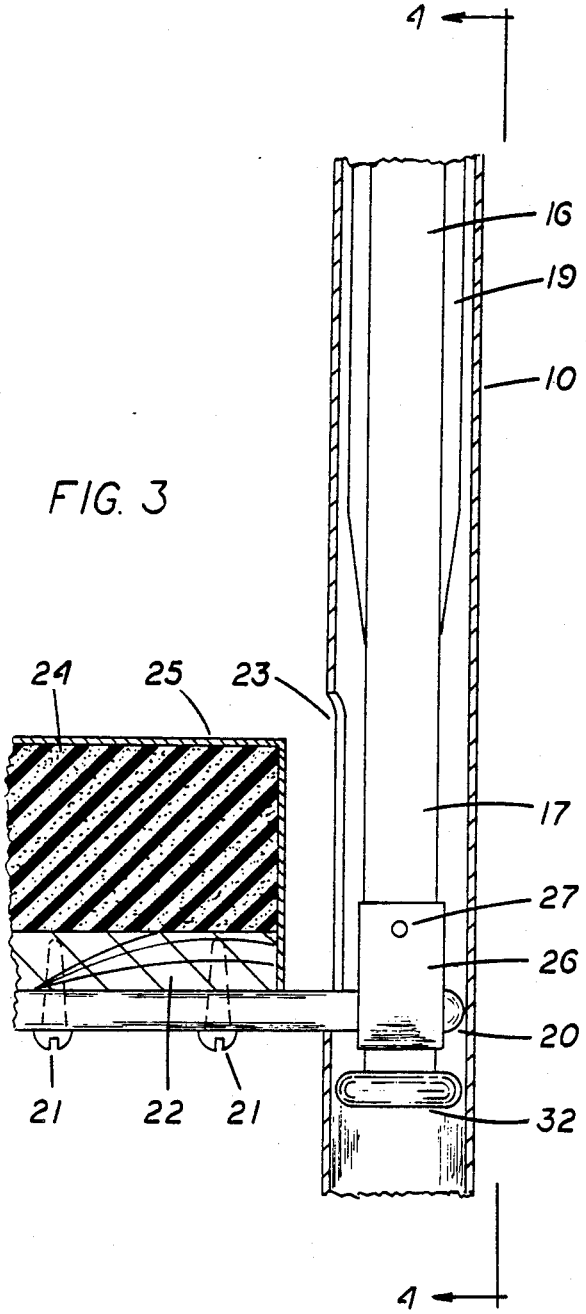
FIG. 3 is a fragmentary sectional view taken along line 3—3 of FIG. 2 in the direction indicated by the arrows.

In FIG. 3 it can be seen that the motion of the seating is guided by a round pin 20 which is fastened by screws 21 to the plywood lower portion 22 of seat board 13. Pin 20 moves within a slot 23 machined on the side of the frame 10 facing the seating. A foam cushion 24 is provided covering the plywood and a fabric 25 covers the foam cushion.

Figure 4:
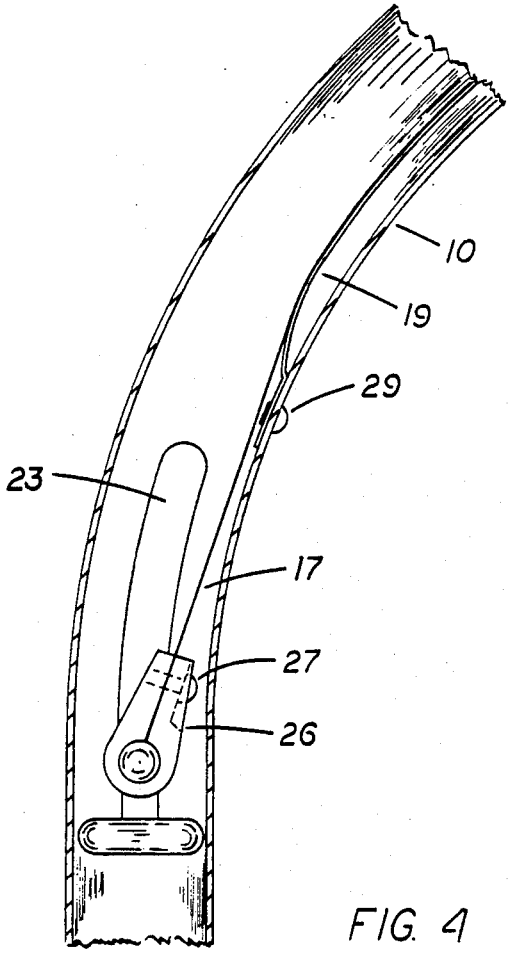
FIG. 4 is a fragmentary sectional view taken along line 4—4 of FIG. 3 in the direction indicated by the arrows.
Figure 6:
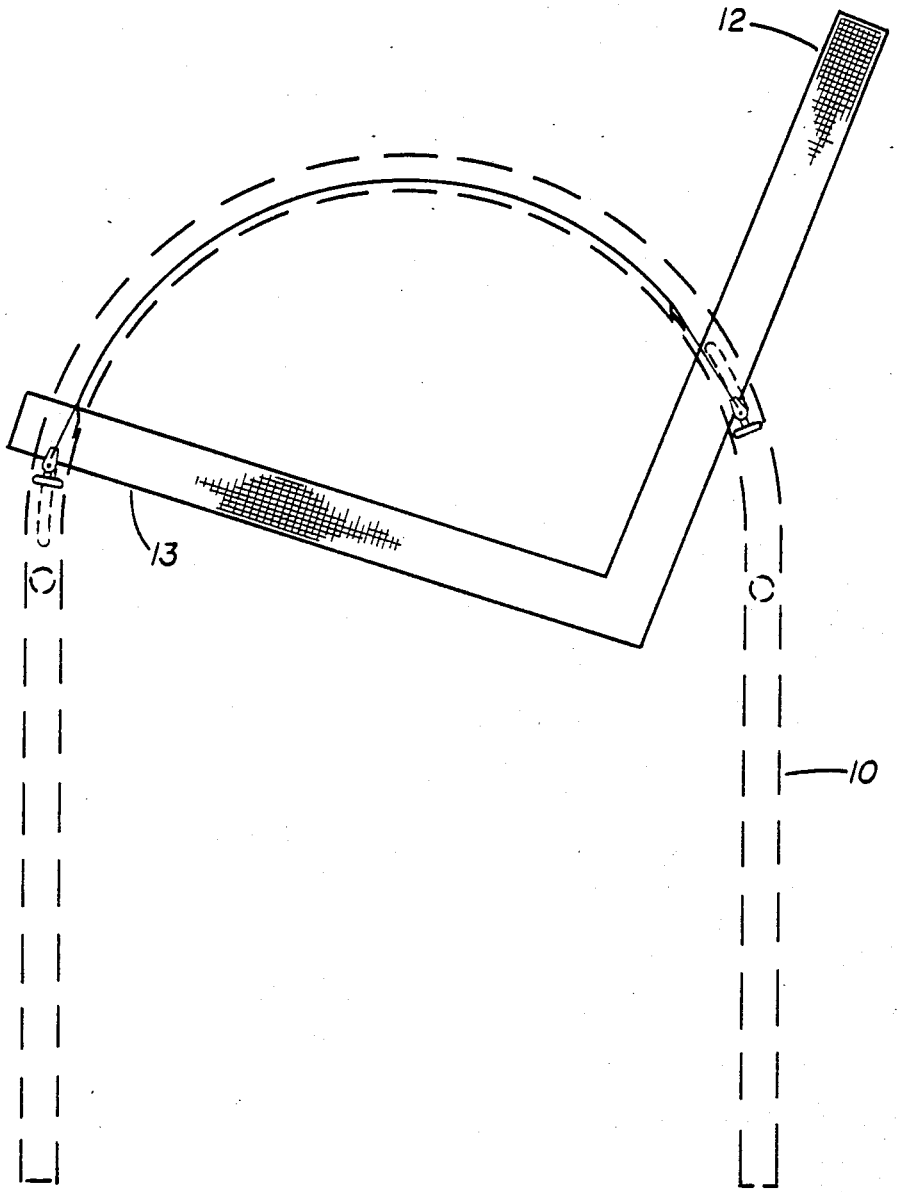

The front end 17 of the flexible strip 16 is attached to a split type plastic bushing 26 by means of a screw 27. Pin 20 is supported by the plastic bushing 26. Attached to the lower end of plastic bushing 26 is a doughnut shaped runner 32 slightly smaller in diameter than the inside of the round tube 10. Runner 32 keeps the flexible member 16 centered over the raceway 19. As shown in FIG. 2, a similar bushing 26 having a doughnut shaped runner 32 is secured to the rear end of the metallic strip 16. With the seating in an upright position as shown in FIG. 2, the pin 20 rest against the lower end of slot 23 as shown in FIG. 3 and FIG. 4. When the seating is in a fully reclined position, as shown in FIG. 6, the pin 20 rest against the upper end of slot 23. Likewise, the rest points are reversed for the back board pin 31, running inside the slot 28.

Figure 5:
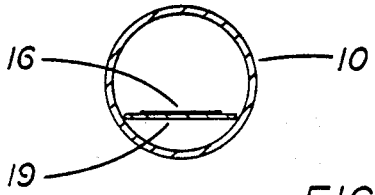
FIG. 5 is a cross-sectional view taken along line 5—5 of FIG. 2 in the direction indicated by the arrows; and, FIG. 6 is a view similar to FIG. 2, but showing the seating in a fully reclining position.

FIG. 5 shows the flexible member 16 running centered over the fixed metallic strip 19. The load placed on the seating is supported by the flexible member 16 and then transferred through the fixed strip 19 edges to the inside of the frame 10 so that the seating is suspended from the frame. Flexible member 16 and the fixed strip 19 may be coated with a friction reducing compound such as Teflon to minimize friction, wear and noise.

Thus, in accordance with the above it will thus be seen that there is provided an apparatus in which the several objects of 15 this invention are achieved and which is well adapted to meet the conditions of novelty and practical usage.

Having thus described the invention, what is claimed is:

1. A reclining chair comprising:

a frame having on opposite sides substantially vertical members connected to each other;

a seating disposed within said frame and comprising a seat board and a back board; and, means for supporting said seating including (1) a flexible strap member connected at its ends to said seating and (2) a fixed raceway disposed between said vertical members, said flexible strap sliding over said raceway.

2. The chair in accordance with claim 1 further comprising means to limit the motion of said seating relative to said frame.

3. The chair in accordance with claim 1 wherein said flexible strap member is secured at one of its ends to said seat board and at the opposite end to said back board.

4. The chair in accordance with claim 1 wherein means are provided to keep said flexible strap member guided while sliding over said raceway.

5. The chair in accordance with claim 1 wherein said frame are hollow and said strap flexible member and said raceway are entirely disposed within said hollow members.

6. The chair in accordance with claim 2 wherein said frame members are hollow and said limiting means includes a slot in a vertical frame member and a pin affixed to said seating and extending into said slot, whereby the ends of said slot limit the movement of said pin.

7. The chair in accordance with claim 1 wherein said flexible strap and raceway are coated with a friction reducing compound.

* * * * *